US006328318B1

(12) United States Patent
Hsu

(10) Patent No.: US 6,328,318 B1
(45) Date of Patent: Dec. 11, 2001

(54) DUAL-PURPOSE ROLLER SKATE

(75) Inventor: Yi-Chuan Hsu, No. 78, Po Tang Hsia, Yu Hua Li, Maio Li City, Miao Li Hsien (TW)

(73) Assignees: Yi-Chuan Hsu, Miao Li Hsien; CD Star Co., Ltd., Taichung, both of (TW)

( * ) Notice: Subject to any disclaimer, the term of this patent is extended or adjusted under 35 U.S.C. 154(b) by 0 days.

(21) Appl. No.: 09/550,618

(22) Filed: Apr. 17, 2000

(30) Foreign Application Priority Data

Mar. 7, 2000 (TW) ..... 89203574

(51) Int. Cl.[7] ..... A63C 17/20

(52) U.S. Cl. ..... 280/11.223; 280/11.233; 280/11.27; 36/115

(58) Field of Search ..... 280/11.223, 11.221, 280/11.232, 11.233, 841, 11.19, 7.13, 11.25, 11.26, 11.27, 43.24; 36/114, 115, 116, 25 R, 132

(56) References Cited

U.S. PATENT DOCUMENTS 3,884,485 * 5/1975 Walle ..... 280/11.1
3,979,842 * 9/1976 Texidor ..... 36/115
3,983,643 * 10/1976 Schreyer et al. ..... 36/115
5,398,970 * 3/1995 Tucky ..... 280/841
5,785,327 * 7/1998 Gallant ..... 280/11.27
5,797,609 * 8/1998 Fichepain ..... 280/11.19
5,882,018 * 3/1999 Petrosino ..... 280/7.13
6,042,125 * 3/2000 Wu ..... 280/11.27
6,120,039 * 9/2000 Clementi ..... 280/11.19
6,247,708 * 6/2001 Hsu ..... 28/11.223

* cited by examiner

*Primary Examiner*—J. J. Swann
*Assistant Examiner*—J. Allen Shriver
(74) *Attorney, Agent, or Firm*—Browdy and Neimark

(57) ABSTRACT

A dual-purpose roller skate comprises a boot, a sole plate provided with a plurality of receiving compartments, and a plurality of wheel sets equal in number to the receiving compartments. The wheel sets are pivoted to the receiving compartments of the sole plate such that the wheels of the wheel sets can be extracted from or retracted into the receiving compartments of the sole plate by an adjustment device.

8 Claims, 4 Drawing Sheets

DUAL-PURPOSE ROLLER SKATE

FIELD OF THE INVENTION

The present invention relates generally to a roller skate, and more particularly to a dual-purpose roller skate which can be converted for use as an ordinary shoe.

BACKGROUND OF THE INVENTION

As shown in FIG. 1, a dual-purpose roller skate of the prior art comprises a bottom plate 1 which is attached to the underside of a main body (not shown in the drawing). The bottom plate 1 is provided in the underside thereof with two protrusions 2 corresponding in location to the toe portion and the heel portion of the bottom plate 1. The bottom plate 1 is disposed in an outsole 3 which is provided therein with two receiving cells 4 for receiving the two protrusions 2. Two roller sets 5 are fastened with the two protrusions 2 by a plurality of fastening screws. The roller sets 5 are formed of a fastening seat 6, a pivoting seat 7, and a wheel 8 which can be extracted from or retracted into the receiving cell 4. The two wheels 8 are extracted to enable the dual-purpose roller skate to be used as a roller skate. The two wheels 8 are retracted into the receiving cells 4 of the outsole 3 at such time when the dual-purpose roller skate is to be used as an ordinary footwear.

Such a prior art dual-purpose roller skate as described above is defective in design in that the outsole 3 is so thick as to accommodate the two roller sets 5 at the expense of the pliability of the outsole 3. In addition, the excessive thickness of the outsole 3 gives an added weight to the roller skate. Moreover, the extraction or retraction of the wheel 8 is done with finger which is apt to be soiled with dirt or even injured.

SUMMARY OF THE INVENTION

The primary objective of the present invention is to provide a dual-purpose roller skate free from the drawbacks of the dual-purpose roller skate of the prior art.

In keeping with the principle of the present invention, the foregoing objective of the present invention is attained by a dual-purpose roller skate comprising a boot, a sole plate provided in the underside thereof with two receiving compartments, and two wheel sets, with each comprising a wheel seat, a wheel frame, a wheel, an adjustment device, and a locating device. The wheel seat is mounted in the receiving compartment. The wheel frame is fastened pivotally with the wheel seat by the adjustment device. The wheel is pivoted to the wheel frame which can be actuated to swivel by an external force exerting on the adjustment device. The locating device is used to locate the wheel frame in the wheel seat.

DETAILED DESCRIPTION OF THE INVENTION

Figure 1:
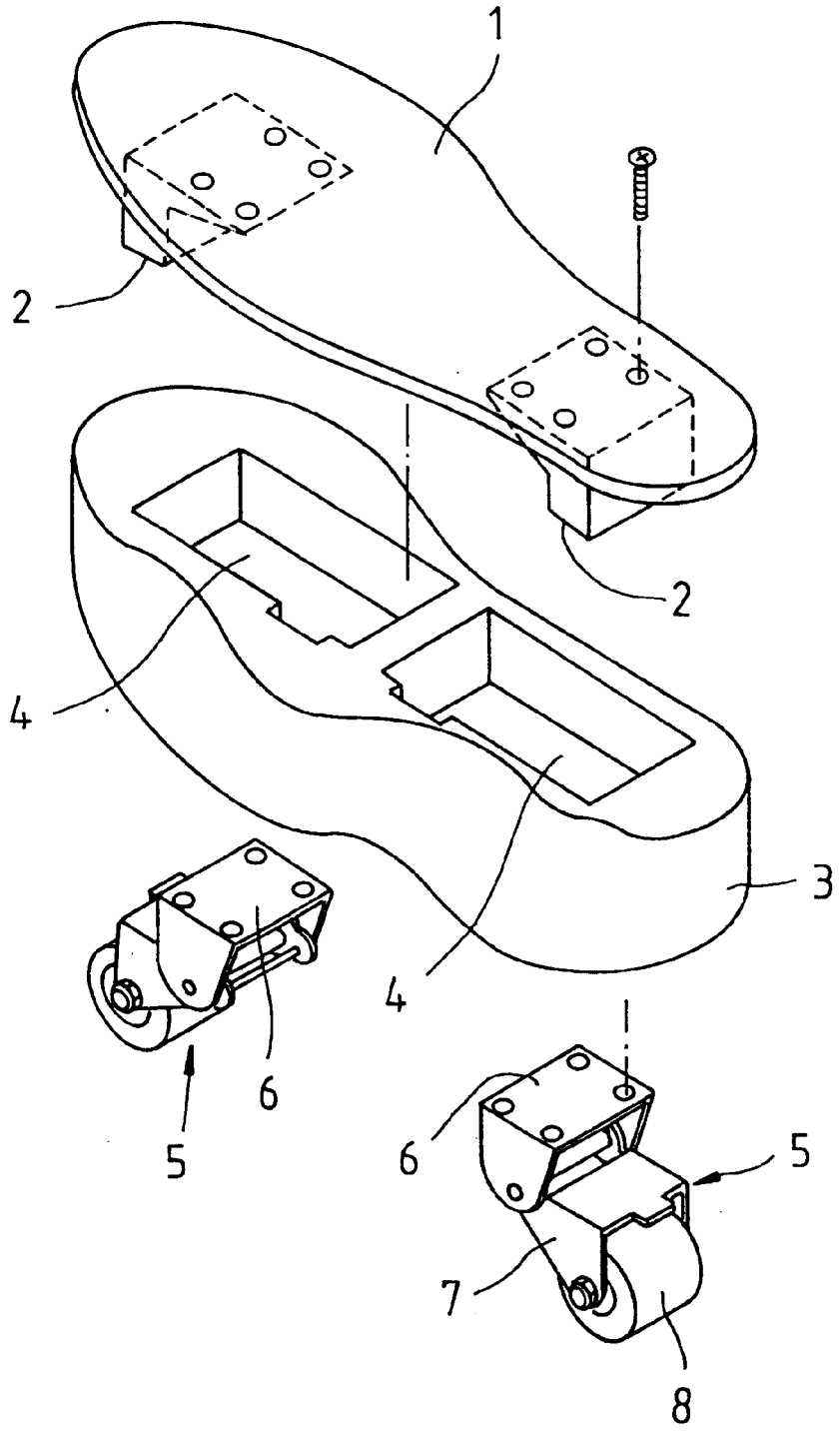
FIG. 1 PRIOR ART
FIG. 1 shows an exploded view of a dual-purpose roller skate of the prior art.
Figure 2:
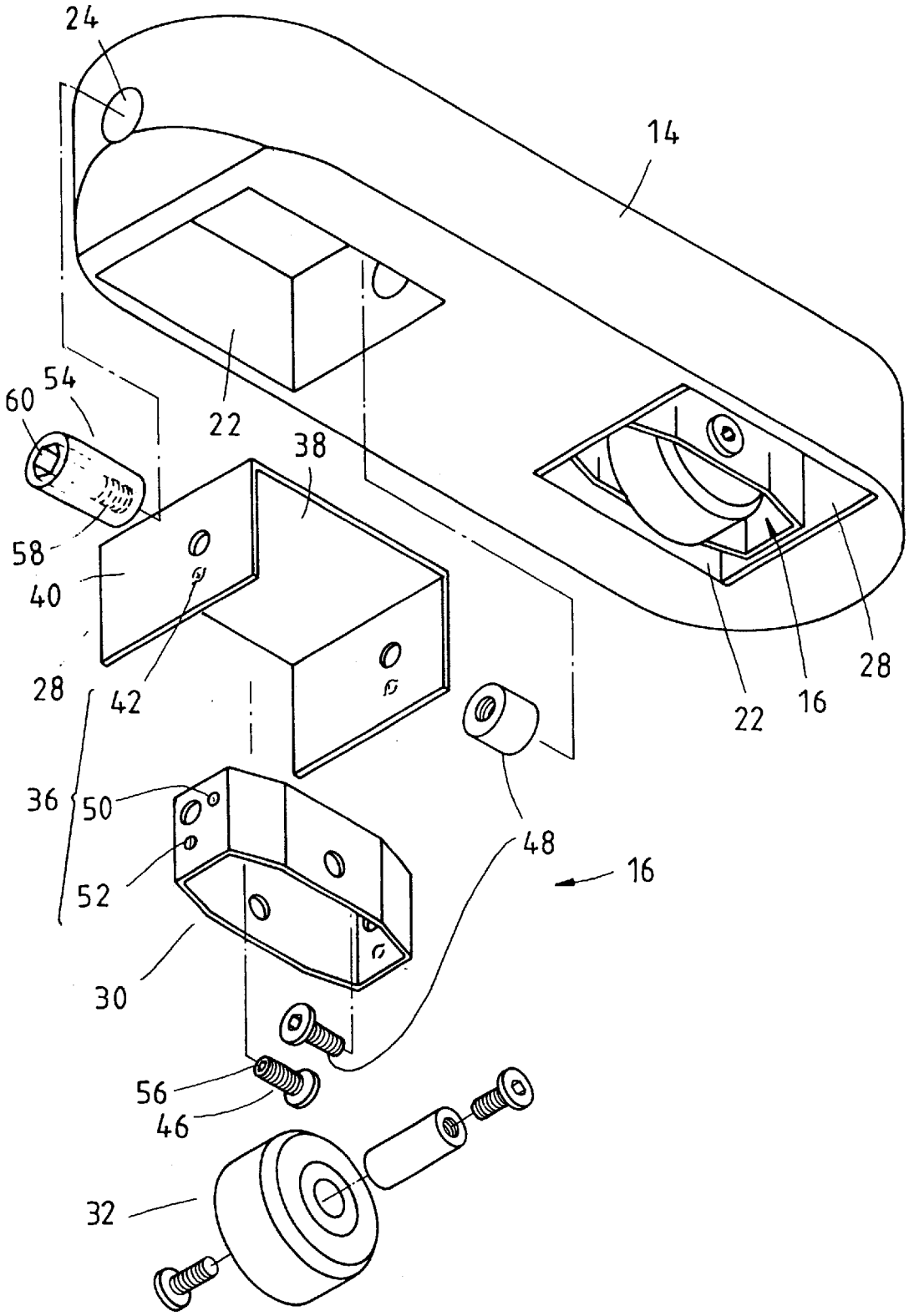
FIG. 2 shows an exploded view of a dual-purpose roller skate of a preferred embodiment of the present invention.

As shown in FIGS. 2–6, a dual-purpose roller skate embodied in the present invention comprises a boot 12, a sole plate 14, and two wheel sets 16.

The boot 12 is mounted on the sole plate 14 which is made of a foam material and is provided in the underside thereof with two receiving compartments 22 corresponding respectively in location to the toe portion and the heel portion of the sole plate 14. The toe portion and the heel portion are provided with a through hole 24 in communication with the receiving compartment 22.

The wheel sets 16 are formed respectively of a wheel seat 28, a wheel frame 30, a wheel 32, an adjustment device 34, and a locating device 36.

The wheel seat 28 has a top plate 38 and two side plates 40 extending from two longitudinal ends of the top plate 38 and perpendicular to the top plate 38. The wheel seat 28 is lodged in the receiving compartment 22.

The wheel frame 30 is fastened pivotally between the two side plates 40 of the wheel seat 28 by an adjusting member 46 and a pivoting member 48.

The wheel 32 is mounted on an axle which is fastened with the wheel frame 30.

The adjustment device 34 comprises the adjusting member 46 and a locking member 54. The adjusting member 46 has a tip which is provided with a hexagonal adjustment slot 56. The tip may be replaced by a slotted tip or phillips tip. The locking member 54 is a sleeve which is provided in one end thereof with an inner threaded hole 58 and in other end thereof with a hexagonal inner hole 60. The locking member 54 is put through the through hole 24 such that the locking member 54 presses against the side plate 40, and that the inner threaded hole 58 is engaged with the adjustment member 46.

The locating device 36 includes two first retaining portions 42 of the side plates 40 of the wheel seat 28, and two second retaining portions 50 and 52 of the wheel frame 30, which are recesses or projections engageable with the first retaining portions 42 which are projections or recesses.

Figure 3:
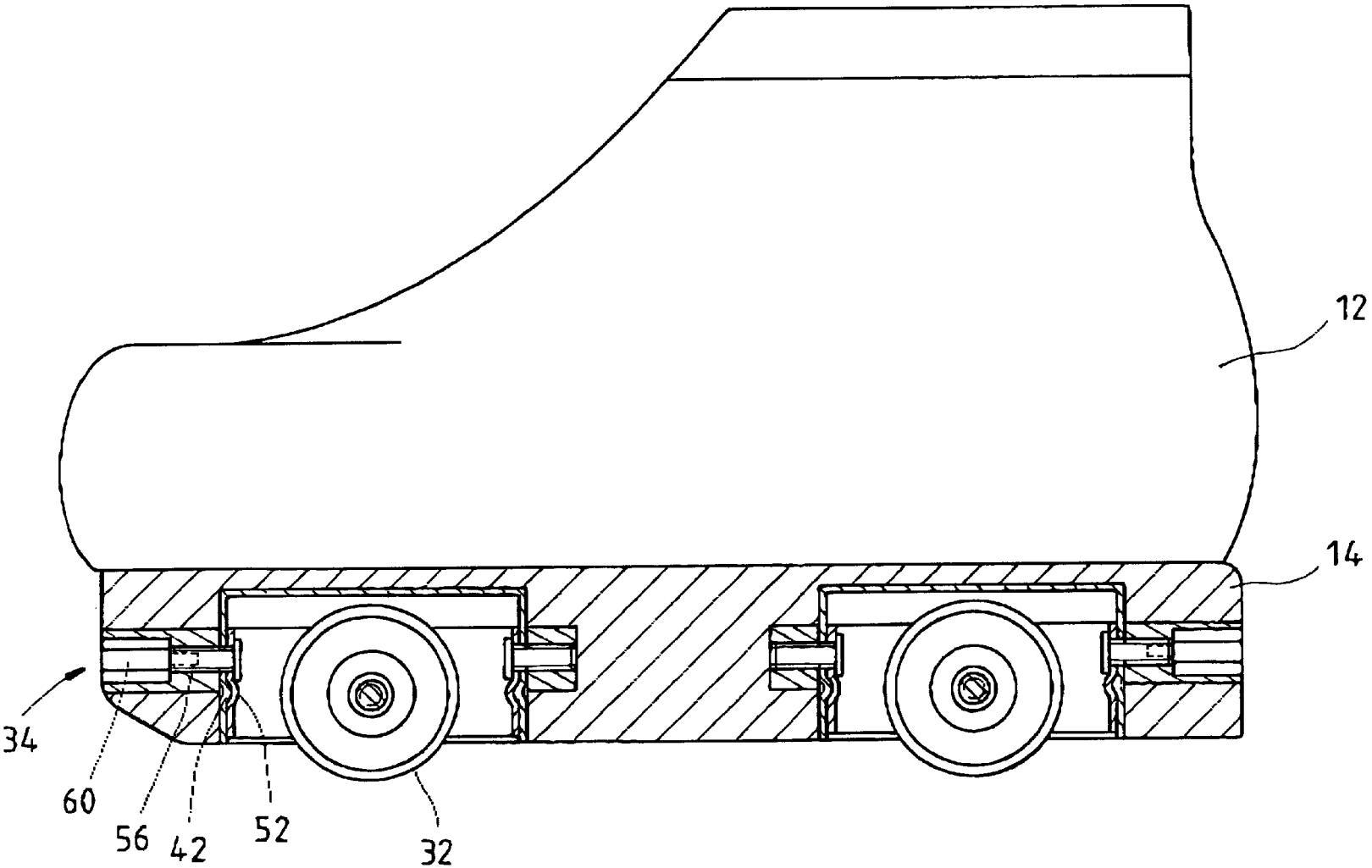
FIG. 3 shows a longitudinal sectional view of the preferred embodiment of the present invention.
Figure 4:
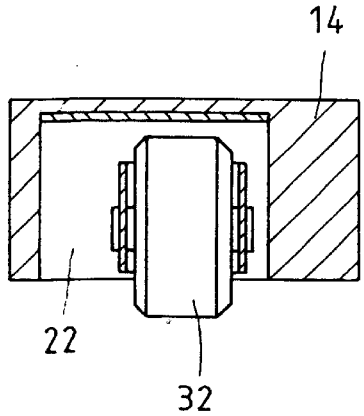

As illustrated in FIGS. 3 and 4, the present invention is used as a roller skate by first loosening the locking member 54 to result in the formation of a gap between the wheel frame 30 and the side plates 40 of the wheel seat 28. Thereafter, the wheel frame 30 is turned by a hexagonal wrench which is engaged with the hexagonal adjustment slot 56 of the adjusting member 46. As a result, the wheel 32 is extracted out of the receiving compartment 22 such that the wheel 32 is located by the first retaining portions 42 and the second retaining portions 52. Finally, the locking member 54 is tightened up.

Figure 5:
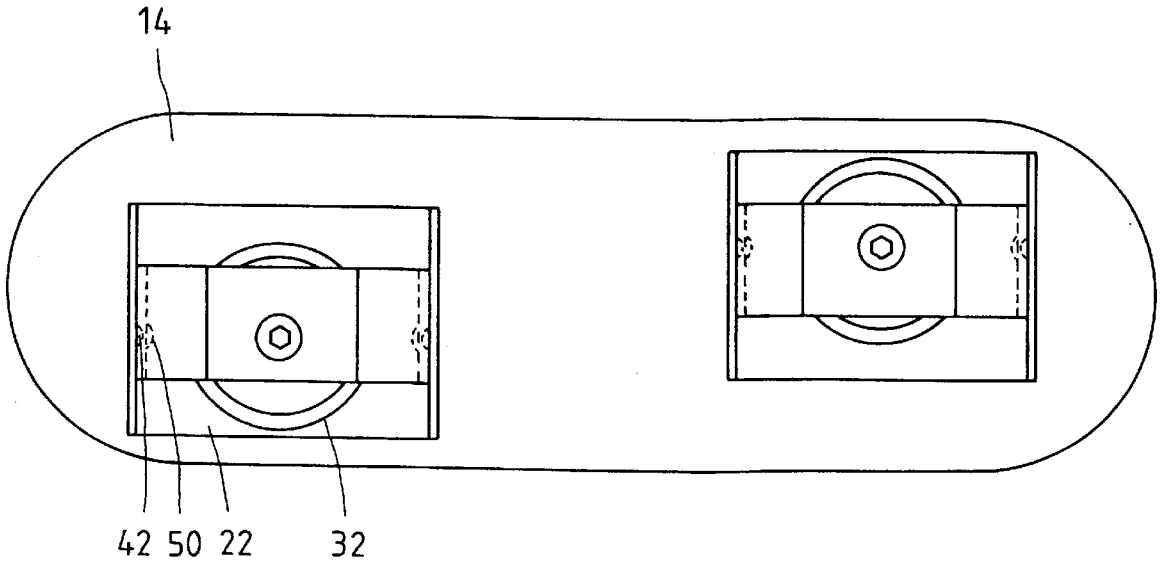
FIGS. 4–6 show schematic views of the preferred embodiment of the present invention in action.
Figure 6:
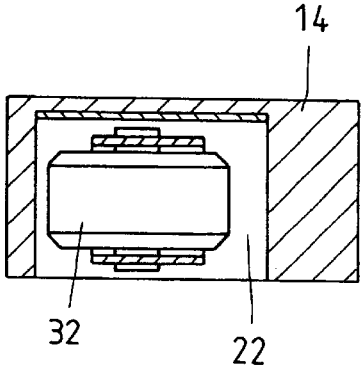

As illustrated in FIGS. 5 and 6, the present invention is used as an ordinary footwear by loosening the locking member 54 so as to retract the wheel 32 back into the receiving compartment 22 by turning the wheel frame 30 in reverse such that the first retaining portions 42 are engaged with the second retaining portions 50.

The embodiment of the present invention described above is to be regarded in all respects as being merely illustrative and not restrictive. Accordingly, the present invention may be embodied in other specific forms without deviating from the spirit thereof. The present invention is therefore to be limited only by the scopes of the following appended claims.

What is claimed is:

1. A dual purpose roller skate comprising:

a boot;

a sole plate mounted on the boot having on an underside thereof a plurality of receiving compartments;

a plurality of wheel sets, equal in number to said receiving compartments, each being formed of a wheel-seat respectively fastened in each of the receiving compartments, a wheel frame rotatably engaged in the wheel seat and a wheel rotatably engaged in the wheel frame;

an adjustment means engaged between said wheel seat and wheel frame for rotating and fixing the wheel frame in preselected positions;

said adjustment means comprising an adjusting member and a locking member located in a through hole in the sole plate communicating with each of the receiving compartments, said adjusting member being engageable at a first end with the wheel frame and threadedly engaged at a second end with the locking member so that the adjusting member can be rotated through the through hole to move the wheel frame to the preselected positions and the locking member rotated to fixedly engage the wheel seat in the preselected positions.

2. The dual-purpose roller skate as defined in claim 1, wherein said adjusting member has a tip at the second end whereby said tip is provided with a hexagonal slot.

3. The dual-purpose roller skate as defined in claim 2, wherein said tip of said adjusting member is a slotted tip.

4. The dual-purpose roller skate as defined in claim 2, wherein said tip of said adjusting member is a phillips tip.

5. The dual-purpose roller skate as defined in claim 1, wherein said locking member is a sleeve whereby said sleeve is provided in a first end thereof with an inner threaded hole and in a second end thereof with a polygonal inner hole.

6. The dual-purpose roller skate as defined in claim 1, wherein the fixed positions are formed by at least one first retaining portion disposed in said wheel seat, and a plurality of second retaining portions disposed in said wheel frame such that said second retaining portions are engageable with the first retaining portion.

7. The dual-purpose roller skate as defined in claim 6, wherein said first retaining portion is a projection; and wherein said second retaining portions are recesses.

8. The dual-purpose roller skate as defined in claim 6, wherein said first retaining portion is a recess; and wherein said second retaining portions are projections.

* * * * *